US008188683B2

(12) United States Patent
Huang et al.

(10) Patent No.: US 8,188,683 B2
(45) Date of Patent: May 29, 2012

(54) POLY-CHROMATIC LIGHT-EMITTING DIODE (LED) LIGHTING SYSTEM

(75) Inventors: Bin-Juine Huang, Taipei (TW); Chun-Wen Tang, Taipei (TW); Fu-Cheng Wang, Taipei (TW)

(73) Assignee: National Taiwan University, Taipei (TW)

( * ) Notice: Subject to any disclaimer, the term of this patent is extended or adjusted under 35 U.S.C. 154(b) by 170 days.

(21) Appl. No.: 12/805,658

(22) Filed: Aug. 12, 2010

(65) Prior Publication Data

US 2011/0193485 A1 Aug. 11, 2011

(30) Foreign Application Priority Data

Feb. 11, 2010 (TW) ..... 99104269 A

(51) Int. Cl.
*G05F 1/00* (2006.01)

(52) U.S. Cl. ..... 315/307; 315/308; 315/149; 315/224; 315/291; 315/312

(58) Field of Classification Search ..... 315/308, 315/307, 149, 224, 291, 312; 345/76–78, 345/102; 362/612, 800
See application file for complete search history.

(56) References Cited

U.S. PATENT DOCUMENTS 7,573,210 B2 * 8/2009 Ashdown et al. ..... 315/307
7,868,562 B2 * 1/2011 Salsbury et al. ..... 315/307
* cited by examiner

*Primary Examiner* — Shawki S Ismail
*Assistant Examiner* — Christopher Lo
(74) *Attorney, Agent, or Firm* — Bacon & Thomas, PLLC

(57) ABSTRACT

The invention discloses a novel control system for a Poly-Chromatic light-emitting diode (LED) lighting system, and applies feed forward and feedback control techniques to regulate the color and luminous outputs. Also, the control system is proposed for achieving luminous and color consistency for Poly-Chromatic LED lighting.

36 Claims, 1 Drawing Sheet

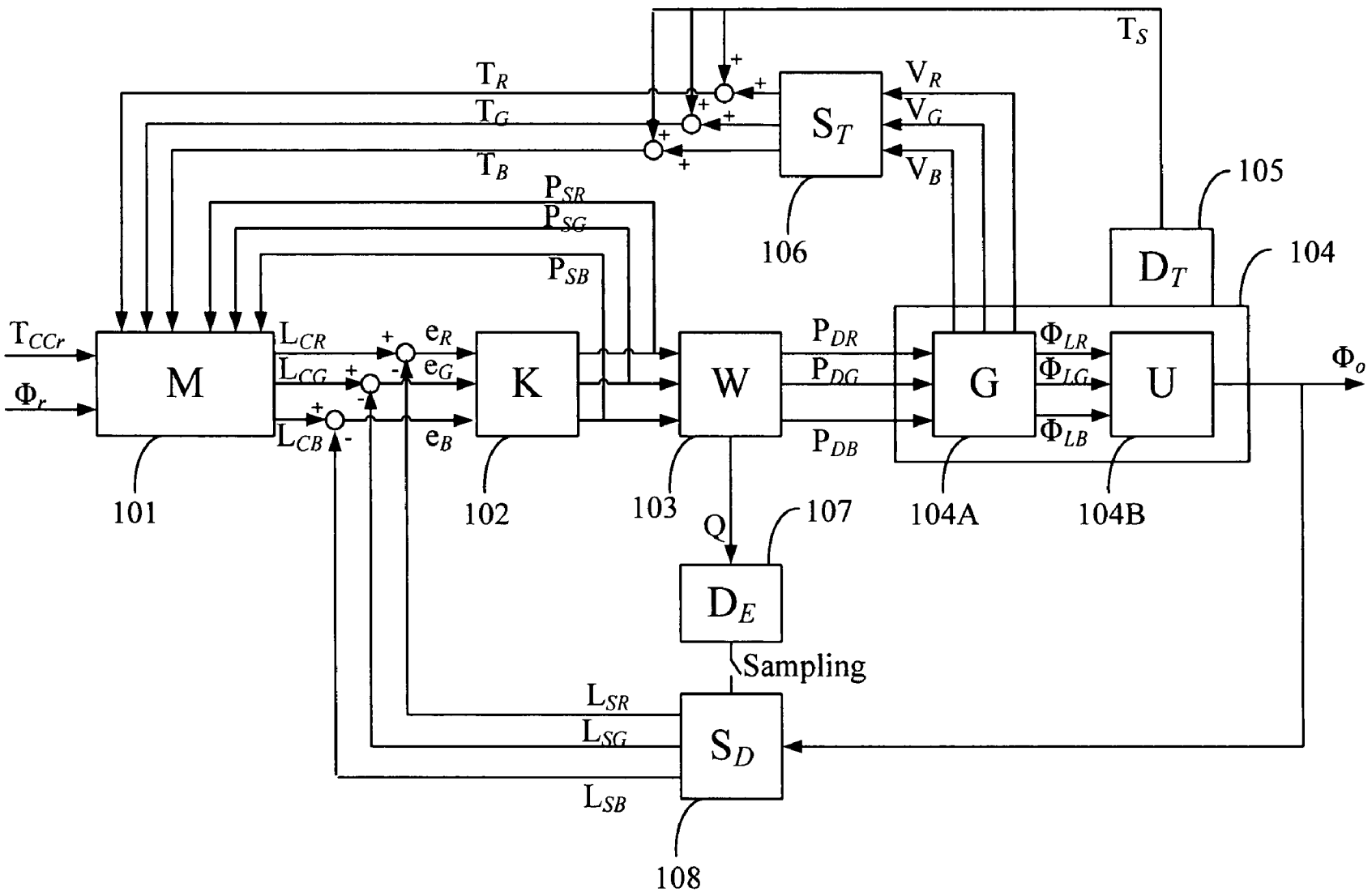
M
101
K
102
W
103
G
104A
U
104B
104
$D_T$
105
$S_T$
106
$D_E$
107
$S_D$
108
Sampling
$\Phi_o$
$\Phi_r$
$T_{CCr}$
$T_S$
$V_R$
$V_G$
$V_B$
$T_R$
$T_G$
$T_B$
$P_{SR}$
$P_{SG}$
$P_{SB}$
$P_{DR}$
$P_{DG}$
$P_{DB}$
$\Phi_{LR}$
$\Phi_{LG}$
$\Phi_{LB}$
Q
$L_{CR}$
$L_{CG}$
$L_{CB}$
$e_R$
$e_G$
$e_B$
$L_{SR}$
$L_{SG}$
$L_{SB}$

POLY-CHROMATIC LIGHT-EMITTING DIODE (LED) LIGHTING SYSTEM

BACKGROUND OF THE INVENTION

1. Field of the Invention

The invention relates to a control system for a poly-chromatic light-emitting diode (LED) lighting system, particularly to a control system for a poly-chromatic light-emitting diode lighting system with lighting forward and junction temperature feedback control.

2. Description of the Prior Art

The Light Emitting Diode (LED) has many advantages, such as small volume, high lighting efficiency, quick response speed, long life, low power consumption, and so on. It can be used to replace the traditional lighting bulbs and lamps which are of high power consumption, short utilization life, and high pollution. Thus, the LED has already been applied as the new-generation lighting equipments.

The LED is also applied as the white light sources. That is, the red, green, and blue lights (or more than three lights) are mixed to form white light. Because the spectrum of natural white light is ranged from about 400 nm to 720 nm, the synthetic white light can consist of the red, green and blue (RGB) lights or more than three lights. Similarly, the poly-chromatic light can be synthesized by three (red, green, blue) or more than three LED lights. However, the spectrum of LED is influenced by the input power and the junction temperature. Therefore, when the electrical power or the junction temperature is changed, the spectrum of poly-chromatic LED will also be changed, and the luminance and color (related color temperature) of the output light will be influenced. Therefore, it is difficult to control the luminance and color of LED. Hence, it is very urgent to obtain the control device and method of poly-chromatic LED at present.

As for the example of a conventional three-chromatic LED lighting system, the model of LED lighting systems is non-linear and time-varying. Most conventional well-known systems use the open-loop control or simple closed-loop control, which is not effective in that the luminance and color of lighting source will drift, and the LED system cannot achieve good performance.

For example, Taiwan Patent No. 200723194 related to a LED lighting system, which is used to produce poly-chromatic LED lighting sources, and the difference between the set point value and first control data is used to control the LED lighting sources. It uses the filtering-type photodiode as the color sensor, and evaluates the junction temperature by the temperature sensor and the thermal resistance of LED. In addition, U.S. Pat. No. 7,573,210 relates to a lamp system and a method for feedback control. The system discloses a lamp with the chromaticity and the digital output signals. The lamp contains spectrum filtering elements and light sensors for providing optical feedback, such that the unnecessary optical signals can be removed and filtered. The control system can sample the filtered signals according to the preset feedback sampling spectrum, and control the chromatic output according to the feedback signals. However, the measurement of LED junction temperature is not disclosed for control of luminance. Furthermore, both afore-mentioned patents do not disclose the use of "non-filtering-type photodiodes" as light sensors for detecting color, and the direct measure of junction temperature of LED for luminance and color control.

Therefore, in order to produce more effective LED, it is necessary to research and develop innovative LED technology, and then to stabilize the luminance and color of LED, and raise the efficiency of light sources, also, reduce the manufacturing time and the manufacturing cost.

SUMMARY OF THE INVENTION

The invention provides a novel control system for a poly-chromatic light-emitting diode (LED) lighting system, and uses feed forward and feedback control techniques to regulate the color and luminous outputs.

The poly-chromatic LED lighting system comprises feed forward compensator M, feedback controller K, driver W, poly-chromatic LED luminaire (including one or more than one LED lamp G and luminaire mixing optical element U), temperature sensor $D_T$, voltage measuring device $S_T$, wide-spectrum sensor $S_D$, and time-division measuring device $D_E$. The feed forward compensator M connects with the feedback controller K, driver W, poly-chromatic LED luminaire, and wide-spectrum sensor $S_D$. The time-division measuring device $D_E$ connects the wide-spectrum sensor $S_D$. The temperature sensor $D_T$ is installed on the poly-chromatic LED luminaire. The voltage measuring device $S_T$ is connected between the LED lamp and the feed forward compensator M.

The invention also provides the utilization methods for a poly-chromatic LED lighting system. The related color temperature command $T_{CCr}$ and the luminance command $\Phi_r$ are transformed to the corresponding light power command $L_C$ of the poly-chromatic LED by the feed forward compensator M. And the light power command $L_C$ and the feedback light power signal $L_s$ are used to calculate the power error signal e of the poly-chromatic LED. Then the signals e enters the feedback controller K, which outputs the luminaire power signal $P_S$ of the poly-chromatic luminaire. The luminaire power signal $P_S$ returns to the feed forward compensator M, and also arrives at the driver W. The driver W outputs the driving power $P_D$ to the poly-chromatic LED luminaire, and also outputs the measured sampling signal Q to the time-division measuring device $D_E$. The temperature sensor $D_T$ measures the shell temperature of the poly-chromatic LED luminaire to generate the temperature signal $T_S$, and the voltage measuring device measures the voltage signal V of the poly-chromatic LED. The junction temperature signal T of poly-chromatic LED can be calculated by the temperature signal $T_S$ and the voltage signal V, and is transmitted to the feed forward compensator M. The poly-chromatic luminance $\Phi_L$ of the poly-chromatic LED passes through the luminaire mixing optical element U, and mixes the poly-chromatic light into the lighting luminance $\Phi_o$. The wide-spectrum sensor $S_D$ measures the lighting luminance $\Phi_o$, and uses the time-division measuring device $D_E$ to separate the power feedback signal $L_S$, and transmits it to the circuit between the feed forward compensator M and the feedback controller K, in order to calculate the power error signal e.

The system employs the measured luminaire power signal $P_S$ and feedback junction temperature signal T of poly-chromatic luminaire to adjust the light power command $L_C$ of the poly-chromatic LED lighting system, such that the lighting luminance $\Phi_o$ can track the luminance command $\Phi_r$, and the color output can track the related color temperature command $T_{CCr}$.

The invention employs the voltage of LED and the shell temperature of luminaire to calculate the junction temperature of the poly-chromatic LED, and employs the time-division measuring device and the wide-spectrum sensor to calculate the power signal of the poly-chromatic LED, in order to regulate the driving power of the lighting system. Thus, the output is steady.

The invention employs the feed forward compensation and feedback control to control the luminance and color outputs of the system. The stability and performance can be maintained even when there are disturbances or environmental changes.

Therefore, the advantage and spirit of the invention can be understood further by the following detail description of invention and attached Figures.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 is a graph illustrating a three-chromatic LED lighting system.

DESCRIPTION OF THE PREFERRED EMBODIMENT

The invention relates to a poly-chromatic LED lighting system. Please refer to the embodiment of the poly-chromatic LED lighting system shown in FIG. 1. The included assembly elements are described as the followings:

The feed forward compensator M101 owns the function of obtaining the related color temperature command $T_{CCr}$, the luminance command $\Phi_r$, the luminaire power signal $P_S$ and the junction temperature signal T of the poly-chromatic LED luminaire 104. It can adjust the light power command $L_C$ of the poly-chromatic LED luminaire 104 at any time.

The feedback controller K102 owns the function of stability control. It can regulate the error signal e between the power feedback signal $L_S$ and the light power command $L_C$, and generate the luminaire power signal $P_S$ of the poly-chromatic luminaire 104 according to the error signal e.

The driver W103 employs the Pulse Width Modulation (PWM) to drive the LED lamp. After the afore-mentioned luminaire power signal $P_S$ is obtained, the driving power $P_D$ can be emitted to ignite the poly-chromatic LED lamp. The driver W103 can also output the measured sampling signal Q to the time-division measuring device $D_E$.

The poly-chromatic LED luminaire 104 is composed of the LED lamp G104A with three light colors (or more than three light colors) and the luminaire mixing optical element U1048, which owns the lighting function.

The temperature sensor $D_T$105 employs the thermocouple or the thermistor, which is connected to the poly-chromatic LED luminaire 104 to measure the generated temperature signal $T_S$.

The voltage measuring device $S_T$106 owns the function of measuring voltage. It can measure the forward voltage V for three light colors of the LED lamp G104A. The variance ΔV with respect to the initial forward voltage can be obtained by measuring the forward voltage. Then the junction temperature T of LED can be obtained according to the temperature signal $T_S$ of luminaire:

The junction temperature of red LED: $T_R=T_S+S_{TR}\times\Delta V_R$

The junction temperature of green LED: $T_G=T_S+S_{TG}\times\Delta V_G$

The junction temperature of blue LED: $T_B=T_S+S_{TB}\times\Delta V_B$

These temperature signals are sent back to the feed forward compensator M.

The time-division measuring device $D_E$107 receives the measured sampling signal Q and synchronize the voltage sampling action with the driver W, in order to measure the separated lighting luminance $\Phi_o$ to obtain the feedback light power signal $L_S$.

The Wide-Spectrum Sensor $S_D$108 is the "non-filtering-type photodiode" having the function of sensing the luminance, which can measure the feedback light power signal $L_S$, and then transmit it to the circuit between the feed forward compensator M101 and the feedback controller K102.

As shown in FIG. 1, the afore-mentioned feed forward compensator M101 connects the feedback controller K102, driver W103, poly-chromatic LED luminaire 104 and time-division measuring device $D_E$107. The poly-chromatic LED luminaire 104 connects the wide-spectrum sensor $S_D$108. The time-division measuring device $D_E$107 connects the wide-spectrum sensor $S_D$108. The temperature sensor $D_T$105 is installed on the poly-chromatic LED luminaire 104. The voltage measuring device $S_T$106 is connected between the LED lamp G104A and the feed forward compensator M101.

As shown in FIG. 1, the utilization method for a poly-chromatic LED lighting system is illustrated. After the related color temperature command $T_{CCr}$ and the luminance command $\Phi_r$ are input to the feed forward compensator M101, which can transform $T_{CCr}$ and $\Phi_r$ to the corresponding light power command $L_C$ (including the red light power command $L_{CR}$, the green light power command $L_{CG}$, and the blue light power command $L_{CB}$). The transformation from $T_{CCr}$ and $\Phi_r$ to $L_C$ is nonlinear and is influenced by the system temperature and the operating power.

As shown in FIG. 1, the light power command $L_C$ and the feedback light power signal $L_S$ (including the red feedback light power signal $L_{SR}$, the green feedback light power signal $L_{SG}$, and the blue feedback light power signal $L_{SB}$) are used to calculate the power error signal e (including the red light power error signal $e_R$, the green light power error signal $e_G$, and the blue light power error signal $e_B$). Then the signals enter the feedback controller K102.

As shown in FIG. 1, the feedback controller K102 outputs the luminaire power signal $P_S$ (including the red light luminaire power signal $P_{SR}$, the green light luminaire power signal $P_{SG}$, and the blue light luminaire power signal $P_{SB}$). The luminaire power signal $P_S$ returns to the feed forward compensator M101, and also arrives at the driver W103.

As shown in FIG. 1, the driver W103 outputs the driving power $P_D$ (including the red light driving power $P_{DR}$, the green light driving power $P_{DG}$, and the blue light driving power $P_{DB}$) to the poly-chromatic LED luminaire 104, and the driver W103 also outputs the measured sampling signal Q to the time-division measuring device $D_E$.

As shown in FIG. 1, the voltage measuring device $S_T$106 measures the voltage signal V (including the red light voltage signal $V_R$, the green light voltage signal $V_G$, and the blue light voltage signal $V_B$) of the LED lamp G104A in the poly-chromatic LED luminaire 104.

The temperature sensor $D_T$105 is connected to the poly-chromatic LED luminaire 104, and can transmit the temperature signal $T_S$, which is used to calculate the junction temperature signal T (including the red light junction temperature signal $T_R$, the green light junction temperature signal $T_G$, and the blue light junction temperature signal $T_B$) with the voltage signal V.

As shown in FIG. 1, the LED lamp G104A can also transmit the three-chromatic luminance $\Phi_L$ (including red light luminance $\Phi_{LR}$, green light luminance $\Phi_{LG}$, and blue light luminance $\Phi_{LB}$) to the luminaire mixing optical element U104B.

As shown in FIG. 1, the luminaire mixing optical element U104B mixes three-chromatic luminance $\Phi_L$, and outputs the light with lighting luminance $\Phi_o$.

As shown in FIG. 1, the wide-spectrum sensor $S_D$108 uses the time-division measuring device $D_E$107 to take samples, and separates lighting luminance $\Phi_o$ into power feedback signal $L_S$, and transmits $L_S$ to the circuit between the feed forward compensator M101 and the feedback controller K102, in order to control the luminance and color of the poly-chromatic LED lighting system.

The feedback controller K102 of the invention can adopt the proportional controller, proportional-integral controller, proportional-derivative controller, proportional-integral-derivative controller, fuzzy controller, and robust controller as the algorithm of feedback control.

The driver W103 of the invention employs the Pulse Width Modulation (PWM) to drive and ignite the LED lamp. High current level is output at the ON interval, and low current level is output at the OFF interval. High current level is the maximum rated current of LED luminaire. Low current level is ranged at between 50 mA and 0.5 mA, 1 mA is selected as low current level in this embodiment. The pulse width is modulated in accordance with the ratio of luminaire power signal. The pulse frequency should be higher than 60 Hertz, in order to avoid the flash feeling of human eyes. 120 Hertz is selected as the pulse frequency in the embodiment. High current level, low current level, and pulse width output by the driving circuit can be regulated accordingly.

Furthermore, the driver W103 of the invention provides three or more than three sets of independent circuits, which can drive three (red, green or blue) or more than three sets of LED. The pulse frequency of every driving circuit is the same. There is a constant time interval at the initial time of ON interval. The time interval is ranged between 1 nanosecond and 150 nanoseconds. 25 nanoseconds are selected as the time interval in the embodiment.

The driver W103 of the invention also provides the measured sampling signal Q, which is a DC voltage pulse signal. When the independent circuit is at the initial time of the ON interval, the measured sampling signal will provide the change of pulse signal for a set of high current level and low current level. Thus the level change of measured sampling signal can be used to recognize the initial driving time of every independent circuit. After the measured sampling signal is transmitted to the time-division measuring device $D_E$107, the measurement action of time-division measuring device and driver can be operated synchronously.

As for the method of measuring the forward voltage V of LED in the invention, low current is used to measure the forward voltage V at the OFF interval. This low current will not heat or ignite the LED lamp, but it can conduct the current to measure the forward voltage V. The relation between the forward voltage of this low current and the junction temperature of LED is linear. When this linear relation is obtained, the junction temperature T of LED can be calculated from the forward voltage V and the temperature Ts of luminaire as follows:

The junction temperature of red LED: $T_R=T_S+S_{TR}\times\Delta V_R$

The junction temperature of green LED: $T_G=T_S+S_{TG}\times\Delta V_G$

The junction temperature of blue LED: $T_B=T_S+S_{TB}\times\Delta V_E$

Because of the precise measurement of junction temperature and the feed forward compensator, the invention will maintain stability and performance even when there are disturbances or environmental changes.

The voltage measuring device of the invention has to measure the forward voltage V within the pulse cycle, thus the measurement sampling time should be less than 1 millisecond. 20 nanoseconds are selected as the measurement sampling time in this embodiment.

In addition, the Wide-Spectrum Sensor $S_D$108 of the invention adopts the "non-filtering-type photodiode" to feed back only one signal. This signal is the luminance signal of all LEDs. Because the driver has a constant time interval for every set of circuits, when the time-division measuring device $D_E$107 takes samples, it can sample and separate the luminance signal for every set of LED (red, green and blue LED). The non-filtering-type photodiode can use a single light sensor to detect the luminance of every color, which will not be offset by the degradation of filtering lens. Because of the precise measurement of luminance signal and feedback, the invention will maintain stability and performance even when there are disturbances or environmental changes.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A poly-chromatic LED lighting system, comprises:

a feed forward compensator, the feed forward compensator having a function of obtaining a related color temperature command, a luminance command, a luminaire power signal and an junction temperature signal of the poly-chromatic LED luminaire, to calculate and adjust a light power command of the poly-chromatic LED luminaire at any time;

a feedback controller, the feedback controller having a function of stable control, which can minimizing an error signal between a feedback light power signal and the light power command, and generate a luminaire power signal of poly-chromatic luminaire in accordance with the error signal;

a driver, the driver using a Pulse Width Modulation (PWM) method to drive the LED lamp, after the luminaire power signal being obtained, a driving power being emitted to turn on a poly-chromatic LED lamp, wherein the driver outputs a measured sampling signal to a time-division measuring device;

a poly-chromatic LED luminaire having a lighting function, the poly-chromatic LED luminaire including a LED lamp and a luminaire mixing optical element;

a temperature sensor, the temperature sensor being connected to the poly-chromatic LED luminaire, and being used to measure a generated temperature of the poly-chromatic LED luminaire;

a voltage measuring device, the voltage measuring device having a function of measuring multiple sets of voltage, and measuring a forward voltage of the LED lamp;

a time-division measuring device, the time-division measuring device receiving a measured sampling signal and synchronizing a voltage sampling action with the driver, measuring at least three sets of separated lighting luminance to obtain the feedback light power signal; and a wide-spectrum sensor, the wide-spectrum sensor having a function of sensing the luminance, measuring the feedback light power signal, and transmitting to the circuit between the feed forward compensator and the feedback controller;

wherein the feed forward compensator connecting the feedback controller, the driver, the poly-chromatic LED luminaire and the time-division measuring device, the poly-chromatic LED luminaire connecting the wide-spectrum sensor, and the time-division measuring device connecting the wide-spectrum sensor, the temperature sensor being installed on the poly-chromatic LED luminaire, the voltage measuring device being connected between the LED lamp and the feed forward compensator, in order to form the poly-chromatic LED lighting system.

2. The system according to claim 1, wherein the feed forward compensator comprises using a tabled calculation.

3. The system according to claim 1, wherein the feed forward compensator comprises using a formula for the calculation.

4. The system according to claim 1, wherein the function of the feed forward compensator comprises receiving a color temperature command, a luminance command, a junction temperature signal, a luminaire power signal, and outputting a light power command.

5. The system according to claim 1, wherein the feedback controller is selected from a group of a proportional controller, a proportional-integral controller, a proportional-derivative controller, a proportional-integral-derivative controller, a fuzzy controller, and a robust controller.

6. The system according to claim 1, wherein the driver comprises three sets of pulse width modulation (PWM) circuit.

7. The system according to claim 1, wherein low current level of driver comprises ranged at between 50 mA and 0.5 mA.

8. The system according to claim 1, wherein the pulse frequency of driver comprises higher than 60 Hertz.

9. The system according to claim 1, wherein the driver comprises more than three driving powers.

10. The system according to claim 1, wherein the initial time interval of driver comprises ranged at between 1 nanosecond and 150 nanoseconds.

11. The system according to claim 1, wherein the light source of the poly-chromatic LED luminaire comprises emitting more than three colors.

12. The system according to claim 1, wherein the light source of the LED lamp comprises emitting more than one color.

13. The system according to claim 1, wherein the temperature sensor is selected from a group of a thermocouple and a thermistor.

14. The system according to claim 1, wherein the voltage measuring device comprises measuring more than three sets of simultaneous forward voltage, and the measurement sampling time being less than 1 millisecond.

15. The system according to claim 1, wherein the wide-spectrum sensor comprises a non-filtering-type photodiode.

16. The system according to claim 1, wherein the time-division measuring device comprises measuring at least more than three sets of feedback light power signal.

17. The system according to claim 1, wherein the measurement sampling time of time-division measuring device being less than 1 millisecond.

18. The system according to claim 1, wherein the time-division measuring device comprises more than three sets of measurement sampling action, and the measurement sampling action having a common delay time interval.

19. A method for using a poly-chromatic LED lighting system, comprises:

input signals which being a color temperature command and a luminance command to a feed forward compensator, transforming to a corresponding light power command, the transformation being nonlinear and influenced by a system temperature set and an operating power set;

using a light power command and a feedback light power signal to calculate an error signal, the error signal entering a feedback controller;

using a feedback controller to return the luminaire power signal to the feed forward compensator, and the luminaire power signal arriving at a driver;

the driver outputting a driving power to the poly-chromatic LED luminaire, and the driver outputting a measured sampling signal to a time-division measuring device, wherein the voltage measuring device measure voltage signal of the poly-chromatic LED luminaire;

connecting a temperature sensor to the poly-chromatic LED luminaire, transmitting a temperature signal, calculating an junction temperature signal with the voltage signal;

using a LED lamp to transmit a poly-chromatic light to a luminaire mixing optical element;

using the mixing optical element of luminaire mixing the luminance of poly-chromatic light, and outputting a lighting luminance; and using a time-division measuring device to take samples, and separating the lighting luminance to obtain a feedback light power signal, and transmitting to a circuit between the feed forward compensator and the feedback controller, in order to regulate a luminance and a color of the poly-chromatic LED lighting system.

20. The method according to claim 19, wherein the feed forward compensator comprises using a tabled calculation.

21. The method according to claim 19, wherein the feed forward compensator comprises using a formula for the calculation.

22. The method according to claim 19, wherein a function of feed forward compensator comprises receiving a color temperature command, a luminance command, a junction temperature signal, a luminaire power signal, and outputting a light power command.

23. The method according to claim 19, wherein the feedback controller is selected from a group of a proportional controller, a proportional-integral controller, a proportional-derivative controller, a proportional-integral-derivative controller, a fuzzy controller, and a robust controller.

24. The method according to claim 19, wherein the driver comprises three sets of pulse width modulation (PWM) circuits.

25. The method according to claim 19, wherein low current level of driver comprises ranged at between 50 mA and 0.5 mA.

26. The method according to claim 19, wherein the pulse frequency of driver comprises higher than 60 Hertz.

27. The method according to claim 19, wherein the driver comprises providing more than three driving powers.

28. The method according to claim 19, wherein the initial time interval of driver comprises ranged at between 1 nanosecond and 150 nanoseconds.

29. The method according to claim 19, wherein the light source of the poly-chromatic LED luminaire comprises emitting more than three colors.

30. The method according to claim 19, wherein the light source of the LED lamp comprises emitting more than one color.

31. The method according to claim 19, wherein the temperature sensor is selected from a group of a thermocouple and a thermistor.

32. The method according to claim 19, wherein the voltage measuring device comprises measuring more than three sets of simultaneous forward voltage, and the measurement sampling time being less than 1 millisecond.

33. The method according to claim 19, wherein the wide-spectrum sensor comprises a non-filtering-type photodiode.

34. The method according to claim 19, wherein the time-division measuring device comprises measuring more than three sets of feedback light power signal.

35. The method according to claim 19, wherein the measurement sampling time of time-division measuring device comprises less than 1 millisecond.

36. The method according to claim 19, wherein the time-division measuring device comprises more than three sets of measurement sampling action, and the measurement sampling action having a common delay time interval.

* * * * *